US010573474B2

(12) United States Patent
Shi et al.

(10) Patent No.: US 10,573,474 B2
(45) Date of Patent: Feb. 25, 2020

(54) INTELLIGENT INTEGRATED MEDIUM-VOLTAGE AC VACUUM SWITCHGEAR BASED ON FLEXIBLE SWITCHING-CLOSING TECHNOLOGY

(71) Applicant: JIANGSU MODERN ELECTRIC TECHNOLOGY CO., LTD, Nantong, Jiangsu (CN)

(72) Inventors: Boyi Shi, Nantong (CN); Yufeng Song, Nantong (CN); Weidong Yao, Nantong (CN); Chunhua Wang, Nantong (CN); Caoxin Gu, Nantong (CN); Mingfeng Gu, Nantong (CN); Linggang Meng, Nantong (CN); Wen Xia, Nantong (CN); Xinming Wang, Nantong (CN); Weifeng Shen, Nantong (CN)

(73) Assignee: JIANGSU MODERN ELECTRIC TECHNOLOGY CO., LTD, Nantong, Jiangsu Province (CN)

( * ) Notice: Subject to any disclaimer, the term of this patent is extended or adjusted under 35 U.S.C. 154(b) by 233 days.

(21) Appl. No.: 15/559,698

(22) PCT Filed: Aug. 21, 2015

(86) PCT No.: PCT/CN2015/087786
§ 371 (c)(1),
(2) Date: Sep. 19, 2017

(87) PCT Pub. No.: WO2016/150090
PCT Pub. Date: Sep. 29, 2016

(65) Prior Publication Data

US 2018/0254159 A1 Sep. 6, 2018

(30) Foreign Application Priority Data

Mar. 26, 2015 (CN) ..... 2015 1 0135376

(51) Int. Cl.
*H01H 33/666* (2006.01)
*H01H 11/00* (2006.01)
(Continued)

(52) U.S. Cl.
CPC ..... *H01H 33/666* (2013.01); *H01H 11/0062* (2013.01); *H01H 33/045* (2013.01);
(Continued)

(58) Field of Classification Search
CPC . H01H 33/66; H01H 33/662–666; H02H 3/00
(Continued)

(56) References Cited

U.S. PATENT DOCUMENTS

2001/0002666 A1* 6/2001 Ito ..... H02B 1/56 218/134
2004/0256360 A1* 12/2004 Kikukawa ..... H01H 33/66207 218/118

(Continued)

*Primary Examiner* — Tuan T Dinh
(74) *Attorney, Agent, or Firm* — Li & Cai Intellectual Property (USA) Office

(57) ABSTRACT

An intelligent integrated medium-voltage alternating current (AC) vacuum switchgear based on a flexible switching-closing technology comprises a controller (24), and a vacuum switching tube (1), an insulator (9), and an switching-closing mechanism connecting piece (15), which are connected in sequence. A microprocessor is built in an intelligent circuit (23); a travel sensor is fixed to a movable contact connecting rod (5), and directly detects a motion state of a movable contact (4) and acquires accurate motion parameters of the movable contact (4); switching-closing operating parameters are obtained by comprehensively calculating arc light intensity detected by an arc light transmitter (20) and a temperature measured by an infrared temperature measuring transmitter (22), such that the switching-closing performance of switching on and switching off a medium-voltage power grid is greatly improved,
(Continued)

switching-closing time points are accurately controlled, and "flexible" switching-closing is achieved.

18 Claims, 1 Drawing Sheet

(51) Int. Cl.
*H01H 33/04* (2006.01)
*H01H 33/26* (2006.01)
*H01H 33/59* (2006.01)
*H01H 33/02* (2006.01)

(52) U.S. Cl.
CPC ..... *H01H 33/26* (2013.01); *H01H 33/59* (2013.01); *H01H 33/022* (2013.01); *H01H 2201/002* (2013.01); *H01H 2221/062* (2013.01)

(58) Field of Classification Search
USPC ..... 361/140–143; 218/123–143, 156
See application file for complete search history.

(56) References Cited

U.S. PATENT DOCUMENTS

2008/0067152 A1* 3/2008 Kikukawa ..... H01H 33/66 218/139
2011/0062117 A1* 3/2011 Tsuchiya ..... H01H 33/6661 218/139
2011/0207302 A1* 8/2011 Wang ..... H01L 21/02532 438/486
2012/0175347 A1* 7/2012 Glaser ..... H01H 33/166 218/140
2012/0193093 A1* 8/2012 James ..... E21B 43/2406 166/267

* cited by examiner

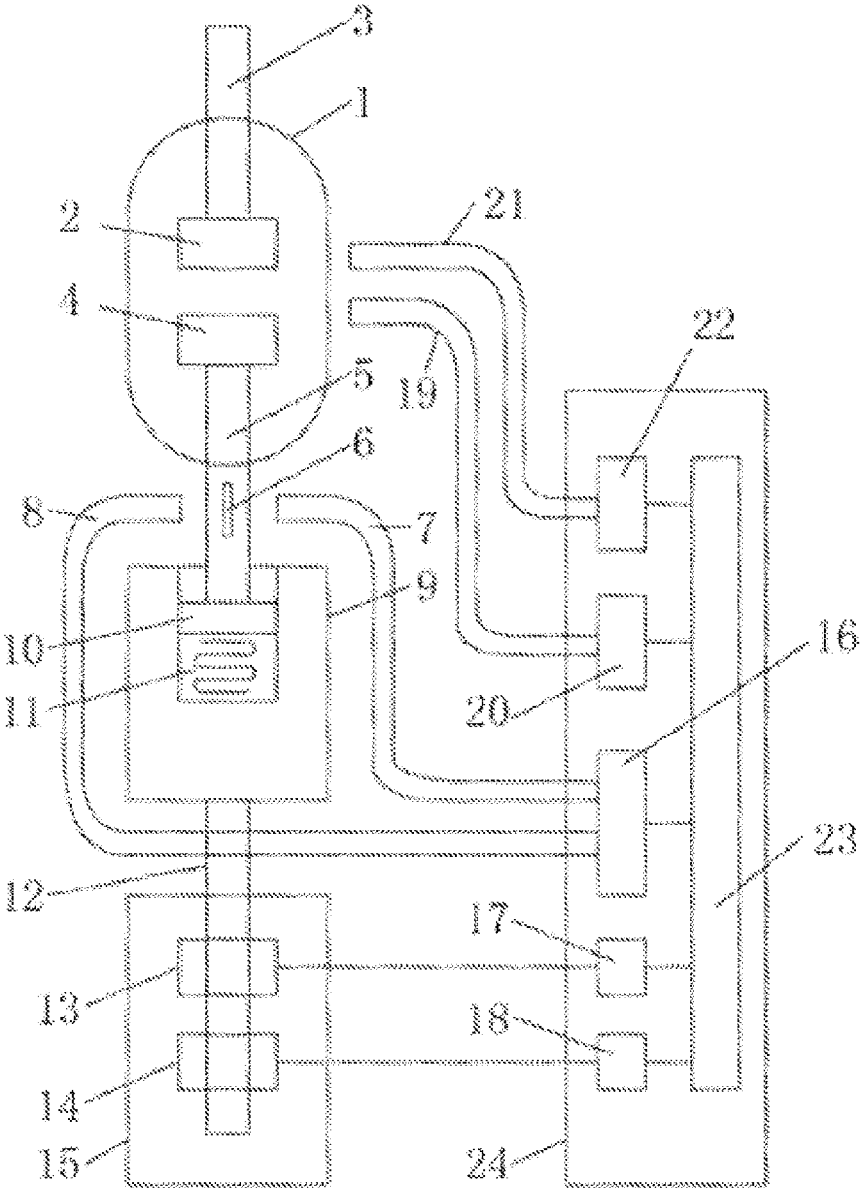
3
1
2
21
4
22
5
19
6
8
7
9
10
16
11
20
23
12
17
13
18
14
15
24

INTELLIGENT INTEGRATED MEDIUM-VOLTAGE AC VACUUM SWITCHGEAR BASED ON FLEXIBLE SWITCHING-CLOSING TECHNOLOGY

BACKGROUND OF THE INVENTION

1. Field of the Invention

The present invention relates to an intelligent integrated medium-voltage alternating current (AC) vacuum switchgear applied to a medium-voltage power grid, and in particular, to an intelligent integrated medium-voltage AC vacuum switchgear based on a flexible switching-closing technology, which belongs to the technical field of electrical switches.

2. Description of Related Art

Patent No. ZL201410015050.7, entitled "integrated high-voltage alternating-current circuit breaker and a protective circuit operating method therefor" and Patent No. ZL201410017012.5, entitled "intelligent integration high-voltage alternating current contactor" both relate to intelligent integrated AC vacuum switchgears. Both the inventions are highly intelligent and integrated. However, in the inventions, a travel sensor or a travel detection circuit (for example, "10" in "ZL201410015050.7" or "9" in "ZL201410017012.5") is mounted at a lower portion of an insulator ("8" in "ZL201410015050.7" or "6" in "ZL201410017012.5"), instead of being mounted on a movable contact or a movable contact leading terminal (for example, "6" in "ZL201410015050.7" or "13" in "ZL201410017012.5") of a switch. Therefore, motion parameters of the movable contact cannot be accurately represented, and as a result, the movable contact of the switch cannot be accurately controlled. Despite being the most important and fundamental characteristic of a switch, the switching-closing performance of switching on and switching off a medium-voltage power grid cannot be greatly improved. A "flexibility" feature is unavailable. There are problems that a switching-closing time is long, three-phase synchronization is poor, time points are uncontrollable, the movable contact jumps during closing, and the movable contact bounces during switching. Therefore, in the switching and closing processes, the harmful impact on the power grid, loads and a switch is severe, and a demand on construction of a strong intelligent power grid cannot be met.

SUMMARY OF THE INVENTION

The object of the present invention is to provide an intelligent integrated medium-voltage AC vacuum switchgear which has a novel structure and performs accurate guide and control on a micro travel motion of a movable contact of a switch to achieve a "flexible" switching-closing performance. The intelligent integrated medium-voltage AC vacuum switchgear has features of good performance, high reliability, and low costs, and is suitable for construction of a strong intelligent power distribution grid.

A technical solution of the present invention provides an intelligent integrated medium-voltage AC vacuum switchgear based on a flexible switching-closing technology. The design points of the technical solution include:

a vacuum switching tube 1, an insulator 9, a switching-closing mechanism connecting piece 15, and a controller 24, the vacuum switching tube 1, the insulator 9, and the switching-closing mechanism connecting piece 15 being axially connected in sequence, wherein the controller 24 includes an intelligent circuit 23, a grating travel transmitter 16, a switching control interface circuit 17, and a closing control interface circuit 18; a microprocessor is built in the intelligent circuit 23, and is configured to calculate switching-closing operating parameters; and the grating travel transmitter 16, the switching control interface circuit 17, and the closing control interface circuit 18 are electrically connected to the intelligent circuit 23;

a grating sheet 6 is disposed on a movable contact connecting rod 5 of the vacuum switching tube 1, an emitting light guide 7 is disposed on one side of the grating sheet 6, a receiving light guide 8 is disposed on the other side of the grating sheet 6, and a light inlet of the receiving light guide 8 is opposite to a light outlet of the emitting light guide 7; and the emitting light guide 7 and the receiving light guide 8 are connected to the grating travel transmitter 16, and the grating travel transmitter 16 is electrically connected to the intelligent circuit 23; and the switching-closing mechanism connecting piece 15 includes a transmission piece 12, a switching mechanism 13, and a closing mechanism 14, the switching mechanism 13 and the closing mechanism 14 are coaxially connected to one end of the transmission piece 12, the other end of the transmission piece 12 is fixedly connected to the insulator 9, and the switching mechanism 13 and the closing mechanism 14 are electrically connected to the switching control interface circuit 17 and the closing control interface circuit 18, respectively.

In application, the present invention also has the following further optimized technical solutions.

Further, a cylinder having an opening at the top is disposed at an upper portion of the insulator 9, an over-travel spring 11 and a piston 10 are sequentially disposed within the cylinder, one end of a piston rod penetrating the top opening of the insulator 9 is fixedly connected to the piston 10, and the other end of the piston rod is fixedly connected to the movable contact connecting rod 5 of the vacuum switching tube 1.

Further, the over-travel spring 11 is a compression spring or a disc spring.

Further, the vacuum switching tube 1 includes a housing, a fixed contact 2, a fixed contact connecting rod 3, a movable contact 4, and the movable contact connecting rod 5, one end of the fixed contact connecting rod 3 is fixedly connected to the fixed contact 2 and is located within the housing, and the other end of the fixed contact connecting rod 3 is fixed to the housing and extends out of the housing; one end of the movable contact connecting rod 5 is fixedly connected to the movable contact 4 and is located within the housing, and the other end of the movable contact connecting rod 5 penetrates the housing and is connected to the housing in a slideable and sealed manner; the fixed contact connecting rod 3 and the movable contact connecting rod 5 are coaxial; and a light transmission part used for light measurement is disposed on the housing.

Further, an infrared temperature measuring light guide 21 and an arc guide 19 are disposed on an outer side of the light transmission part of the vacuum switching tube 1, and the infrared temperature measuring light guide 21 is electrically connected to an infrared temperature measuring transmitter 22 built in the controller 24, and is configured to detect a temperature of the vacuum switching tube 1 in the switching and closing processes; the arc guide 19 is electrically connected to an arc light transmitter 20 built in the controller 24, and is configured to detect arc light intensity generated in the vacuum switching tube 1 in the switching and closing processes; and the infrared temperature measuring transmitter 22 and the arc light transmitter 20 are electrically connected to the intelligent circuit 23, and the intelligent circuit 23 performs calculation according to the detected temperature and arc light intensity to generate switching-closing parameters having a small arc and a small temperature rise.

Further, the infrared temperature measuring light guide 21 and the arc guide 19 are both formed of optical fiber bundles.

Further, the switching-closing mechanism connecting piece 15 includes a mechanism body, the transmission piece 12, the switching mechanism 13, and the closing mechanism 14; the switching mechanism 13 and the closing mechanism 14 are located within the mechanism body and are fixed to one end of the transmission piece 12, and the other end of the transmission piece 12 extends out of the mechanism body.

Further, the switching mechanism 13 includes a magnetic cylinder disposed within the mechanism body and a switching coil fixed to the transmission piece 12, and the closing mechanism 14 includes a magnetic cylinder disposed within the mechanism body and a closing coil fixed to the transmission piece 12.

Further, the emitting light guide 7 and the receiving light guide 8 are formed of optical fiber bundles having a photosensitive characteristic.

Further, a first light condensing device is disposed at the light outlet of the emitting light guide 7, a second light condensing device is disposed at the light inlet of the receiving light guide 8, and the first light condensing device and the second light condensing device are both formed of lenses or lens groups.

For the intelligent integrated medium-voltage AC vacuum switchgear based on a flexible switching-closing technology according to the present invention, in application, a vacuum switching tube is connected to a medium-voltage power grid circuit by using a lead. A travel sensor of the present invention is, for example, a grating sheet, and is directly mounted on and is fixed to a movable contact connecting rod of the vacuum switching tube, and directly detects a motion state of a movable contact of the vacuum switching tube, so that motion parameters of the movable contact can be accurately represented. A human-machine interaction device connected to a controller is used to set parameters, so that the switching-closing performance of switching on and switching off the medium-voltage power grid can be greatly improved. "Flexible" switching-closing is achieved, and switching-closing time points can be accurately controlled. An over-travel spring is disposed within an insulator, so that on one hand, in a closed state, high enough pressure is provided between the movable contact and the fixed contact of the vacuum switching tube, and on the other hand, quick bounce-free switching is achieved. In the switching and closing processes, the harmful impact on the power grid, loads and a switch is quite small, and a demand on construction of a strong intelligent power grid is met.

Beneficial Effects

A travel sensor is directly mounted and is fixed to a movable contact connecting rod of a vacuum switching tube, and directly detects a motion state of a movable contact of the vacuum switching tube, so that motion parameters of the movable contact can be accurately represented. A human-machine interaction device connected by using a controller is used to set parameters, so that the switching-closing performance is greatly improved. Switching-closing time points can be accurately controlled, and "flexible" switching-closing operations are achieved.

By means of an over-travel spring disposed in an insulator, on one hand, in a closed state, enough pressure is maintained between the movable contact and the fixed contact of the vacuum switching tube, and on the other hand, quick bounce-free switching is achieved during switching.

In the switching and closing processes, the harmful impact on the power grid, loads and a switch is quite small, and a demand on construction of a strong intelligent power grid is met.

BRIEF DESCRIPTION OF THE DRAWINGS

FIG. 1 is a schematic structural diagram of the present invention.

In the FIGURE, 1—Medium-voltage AC vacuum switching tube; 2—Fixed contact; 3—Fixed contact connecting rod; 4—Movable contact; 5—Movable contact connecting rod; 6—Grating sheet; 7—Emitting light guide; 8—Receiving light guide; 9—Insulator; 10—Piston; 11—Over-travel spring; 12—Transmission piece; 13—Switching mechanism; 14—Closing mechanism; 15—Switching-closing mechanism connecting piece; 16—Grating travel transmitter; 17—Switching control interface circuit; 18—Closing control interface circuit; 19—Arc guide; 20—Arc light transmitter; 21—Infrared temperature measuring light guide; 22—Infrared temperature measuring transmitter; 23—Intelligent circuit; and 24—Controller.

DETAILED DESCRIPTION OF THE PREFERRED EMBODIMENTS

To illustrate the technical solutions and technical objectives of the present invention, the present invention is further described below with reference to the accompanying drawings and specific embodiments.

As shown in FIG. 1, an intelligent integrated medium-voltage AC vacuum switchgear based on a flexible switching-closing technology according to the present invention includes: a vacuum switching tube 1, an insulator 9, a switching-closing mechanism connecting piece 15, and a controller 24. The vacuum switching tube 1, the insulator 9, and the switching-closing mechanism connecting piece 15 are axially connected in sequence. The controller 24 includes an intelligent circuit 23, a grating travel transmitter 16, a switching control interface circuit 17, a closing control interface circuit 18, an arc light transmitter 20, and an infrared temperature measuring transmitter 22. A microprocessor is built in the intelligent circuit 23, and is configured to calculate switching-closing operating parameters. The grating travel transmitter 16, the switching control interface circuit 17, the closing control interface circuit 18, the arc light transmitter 20, and the infrared temperature measuring transmitter 22 are all electrically connected to the intelligent circuit 23. A grating sheet 6 is disposed on a movable contact connecting rod 5 of the vacuum switching tube 1. An emitting light guide 7 is disposed on one side of the grating sheet 6, and a receiving light guide 8 is disposed on the other side of the grating sheet 6. An end face of a light inlet of the receiving light guide 8 is directly opposite to an end face of a light outlet of the emitting light guide 7. The emitting light guide 7 and the receiving light guide 8 are connected to the grating travel transmitter 16. The emitting light guide 7 and the receiving light guide 8 are formed of optical fiber bundles having a photosensitive characteristic. The optical fiber bundle is made of a high-voltage resistant material such as a quartz material, so that the voltage resistant strength between the two end faces of the emitting light guide 7 and the receiving light guide 8 exceeds a medium-voltage rated voltage by more than 2 times, so as to ensure that insulation safety is met. The switching-closing mechanism connecting piece 15 includes a transmission piece 12, a switching mechanism 13, and a closing mechanism 14. The switching mechanism 13 and the closing mechanism 14 are connected to one end of the transmission piece 12, and the switching mechanism 13, the closing mechanism 14, and the transmission piece 12 are coaxial. The other end of the transmission piece 12 is fixedly connected to the insulator 9. The switching mechanism 13 and the closing mechanism 14 are electrically connected to the switching control interface circuit 17 and the closing control interface circuit 18, respectively. A first light condensing device is disposed at the light outlet of the emitting light guide 7 and a second light condensing device is disposed at the light inlet of the receiving light guide 8, in order to improve signal detection sensitivity. The first light condensing device and the second light condensing device are both formed of lenses or lens groups.

The intelligent circuit 23, the switching control interface circuit 17, the closing control interface circuit 18, the switching mechanism 13, the closing mechanism 14, the switching-closing mechanism connecting piece 15, the transmission piece 12, the insulator 9, a piston 10, an over-travel spring 11, and the movable contact connecting rod 5 form a switching-closing control system. During closing, the intelligent circuit 23 outputs a closing weak-current control electrical signal, and the signal is subjected to power amplification by the closing control interface circuit 18, so as to drive the closing mechanism 14 connected to the switching-closing mechanism connecting piece 15 to move, and thus drive a movable contact 4 to move upwards through the transmission piece 12, the insulator 9, and the movable contact connecting rod 5, to come into contact with a fixed contact 2, thereby achieving a closing operation. During switching, the intelligent circuit 23 outputs a switching weak-current control electrical signal, and the signal is subjected to power amplification by the switching control interface circuit 17, so as to drive the switching mechanism 13 connected to the switching-closing mechanism connecting piece 15 to move, and thus drive the movable contact 4 to move downwards through the transmission piece 12, the insulator 9, and the movable contact connecting rod 5, to disengage from the fixed contact 2, thereby achieving a switching operation.

Switching-closing operating parameters of the movable contact are directly measured. A travel sensor is directly mounted and is fixed to the movable contact connecting rod of the vacuum switching tube, and directly detects a motion state of a movable contact of the vacuum switching tube. During switching and closing, the movable contact connecting rod 5 carries the grating sheet 6 disposed thereon to move together. Detection light emitted by a light-emitting tube in the grating travel transmitter 16 passes through the emitting light guide 7, is condensed by a light condensing device, and is directed to the grating sheet 6. The receiving light guide 8 receives dynamic light which transmits through the grating sheet 6 and is related to motion parameters of the movable contact 4. The grating travel transmitter 16 receives the dynamic light which is incident on the light guide 8. The grating travel transmitter 16 processes the dynamic light and sends the processed light to the intelligent circuit 23 for processing such as analysis and calculation to obtain the motion parameters such as travel, over-travel, speed, and acceleration of the movable contact 4. In the switching and closing processes, the intelligent circuit 23 directly monitors the motion parameters of the movable contact 4, and adjusts driving parameters of the switching mechanism and closing mechanism, so that the switching and closing have "flexible" features in which a short time is required, time points can be controlled, and no bounce occurs in the processes.

An arc guide 19, the arc light transmitter 20, an infrared temperature measuring light guide 21, the infrared temperature measuring transmitter 22, and the intelligent circuit 23 form a flexible switching-closing monitoring system. A major objective of the flexible switching and closing is to achieve a small arc between the movable contact 4 and the fixed contact 2 in the switching and closing processes and a small temperature rise between the movable contact 4 and the fixed contact 2 during closing. The intelligent circuit 23 detects an arc degree in the switching and closing processes by means of the arc guide 19 and the arc light transmitter 20, monitors a temperature rise during closing by means of the infrared temperature measuring light guide 21 and the infrared temperature measuring transmitter 22, and performs comprehensive processing on the obtained motion parameters such as travel, over-travel, speed, and acceleration of the movable contact 4, so as to obtain control parameters for accurate switching and closing, thereby achieving flexible switching and closing. Therefore, an arc is minimized in the switching and closing processes, and a temperature rise is minimized during closing, so as to meet a demand on construction of a strong intelligent power grid.

A cylinder having an opening at the top is disposed at an upper portion of the insulator 9. The over-travel spring 11 and the piston 10 are sequentially disposed within the cylinder. One end of a piston rod penetrating the top opening of the insulator 9 is fixedly connected to the piston 10. The other end of the piston rod is fixedly connected to the movable contact connecting rod 5 of the vacuum switching tube 1. The piston 10 and the over-travel spring 11 enable, after the movable contact 4 is contacted with the fixed contact 2 in the closing process, the insulator 9 and the like to continue to move upwards by a travel (referred to as an over-travel). The over-travel spring 11 is a compression spring, or may be a disc spring. On one hand, in a closed state, enough pressure is maintained between the movable contact and the fixed contact of the vacuum switching tube, so that the movable contact and the fixed contact are in sufficient contact, thereby reducing a contact resistance. On the other hand, during switching, the movable contact 4 has certain acceleration before disengaging from the fixed contact 2, so that the movable contact 4 rapidly accelerates during switching and reaches a certain movement speed, so as to achieve quick bounce-free switching and ensure switching quality.

The vacuum switching tube 1 includes a housing, the fixed contact 2, a fixed contact connecting rod 3, the movable contact 4, and the movable contact connecting rod 5. One end of the fixed contact connecting rod 3 is fixedly connected to the fixed contact 2 and is located within the housing, and the other end of the fixed contact connecting rod 3 is fixed to the housing and extends out of the housing. One end of the movable contact connecting rod 5 is fixedly connected to the movable contact 4 and is located within the housing, and the other end of the movable contact connecting rod 5 penetrates the housing and is connected to the housing in a slideable and sealed manner. The fixed contact connecting rod 3 and the movable contact connecting rod 5 are coaxially arranged, that is, are disposed on two opposite sides of the housing respectively. A light transmission part used for light measurement is disposed on the housing. The infrared temperature measuring light guide 21 and the arc guide 19 are disposed on an outer side of the light transmission part of the vacuum switching tube 1. The infrared temperature measuring light guide 21 is electrically connected to the infrared temperature measuring transmitter 22 built in the controller 24, and is configured to detect a temperature of the vacuum switching tube 1 in the switching and closing processes. The arc guide 19 is electrically connected to the arc light transmitter 20 built in the controller 24, and is configured to detect arc light intensity generated in the vacuum switching tube 1 in the switching and closing processes. The infrared temperature measuring transmitter 22 and the arc light transmitter 20 are electrically connected to the intelligent circuit 23. The intelligent circuit 23 performs calculation according to the detected temperature and arc light intensity to generate switching-closing parameters having a small arc and a small temperature rise. The infrared temperature measuring light guide 21 and the arc guide 19 are both formed of optical fiber bundles, and serve as optical channels for optical signal detection.

The switching-closing mechanism connecting piece 15 includes a mechanism body, the transmission piece 12, the switching mechanism 13, and the closing mechanism 14. The switching mechanism 13 and the closing mechanism 14 are located within the mechanism body and are fixed to one end of the transmission piece 12. The other end of the transmission piece 12 extends out of the mechanism body. The switching mechanism 13 includes a magnetic cylinder disposed within the mechanism body and a switching coil fixed to the transmission piece 12. The closing mechanism 14 includes a magnetic cylinder disposed within the mechanism body and a closing coil fixed to the transmission piece 12. The switching coil and the closing coil are electrically connected to the switching control interface circuit 17 and the closing control interface circuit 18, respectively.

For the intelligent integrated medium-voltage AC vacuum switchgear based on a flexible switching-closing technology according to the present invention, in application, a vacuum switching tube is connected to a medium-voltage power grid circuit by using a lead. A travel sensor of the present invention is, for example, a grating sheet, and is directly mounted on and is fixed to a movable contact connecting rod of the vacuum switching tube, and directly detects a motion state of a movable contact of the vacuum switching tube, so that motion parameters of the movable contact can be accurately represented. A human-machine interaction device connected to a controller is used to set parameters, so that the switching-closing performance of switching on and switching off the medium-voltage power grid can be greatly improved. Switching-closing time points can be accurately controlled and "flexible" switching-closing is achieved. An over-travel spring is disposed within an insulator, so that on one hand, in a closed state, high enough pressure is provided between the movable contact and the fixed contact of the vacuum switching tube, and on the other hand, quick bounce-free switching is achieved. In the switching and closing processes, the harmful impact on the power grid, loads and a switch is quite small, and a demand on construction of a strong intelligent power grid is met.

Compared with the prior art, the present invention has the following technical advancement.

1) A travel sensor is directly mounted and is fixed to a movable contact connecting rod of a vacuum switching tube, and directly detects a motion state of a movable contact of the vacuum switching tube, so that motion parameters of the movable contact can be accurately represented. A human-machine interaction device connected to a controller is used to set parameters, so that the switching-closing performance is greatly improved. Switching-closing time points can be accurately controlled, and "flexible" switching-closing operations are achieved.

2) By means of an over-travel spring disposed in an insulator, on one hand, in a closed state, enough pressure is maintained between the movable contact and the fixed contact of the vacuum switching tube, and on the other hand, quick bounce-free switching is achieved during switching.

3) In the switching and closing processes, the harmful impact on the power grid, loads and a switch is quite small, and a demand on construction of a strong intelligent power grid is met.

The basic principles and main features of the present invention and the advantages of the present invention are shown and described above. A person skilled in the art should understand that the present invention is not limited to the foregoing embodiments. Only the principles of the present invention are described in the foregoing embodiments and the description. Various variations and modifications may further be made to the present invention without departing from the spirit and scope of the present invention. The protection scope of the present invention is defined by the appended claims, the description, and equivalents thereof.

What is claimed is:

1. An intelligent integrated medium-voltage alternating current (AC) vacuum switchgear based on a flexible switching-closing technology, comprising:

a vacuum switching tube (1), an insulator (9), a switching-closing mechanism connecting piece (15), and a controller (24), the vacuum switching tube (1), the insulator (9), and the switching-closing mechanism connecting piece (15) being axially connected in sequence, wherein the controller (24) comprises an intelligent circuit (23), a grating travel transmitter (16), a switching control interface circuit (17), and a closing control interface circuit (18); a microprocessor is built in the intelligent circuit (23), and is configured to calculate switching-closing operating parameters; and the grating travel transmitter (16), the switching control interface circuit (17), and the closing control interface circuit (18) are electrically connected to the intelligent circuit (23);

a grating sheet (6) is disposed on a movable contact connecting rod (5) of the vacuum switching tube (1), an emitting light guide (7) is disposed on one side of the grating sheet (6), a receiving light guide (8) is disposed on the other side of the grating sheet (6), and a light inlet of the receiving light guide (8) is opposite to a light outlet of the emitting light guide (7); and the emitting light guide (7) and the receiving light guide (8) are connected to the grating travel transmitter (16), and the grating travel transmitter (16) is electrically connected to the intelligent circuit (23); and the switching-closing mechanism connecting piece (15) comprises a transmission piece (12), a switching mechanism (13), and a closing mechanism (14); the switching mechanism (13) and the closing mechanism (14) are coaxially connected to one end of the transmission piece (12), the other end of the transmission piece (12) is fixedly connected to the insulator (9), and the switching mechanism (13) and the closing mechanism (14) are electrically connected to the switching control interface circuit (17) and the closing control interface circuit (18), respectively.

2. The intelligent integrated medium-voltage AC vacuum switchgear based on a flexible switching-closing technology according to claim 1, wherein a cylinder having an opening at the top is disposed at an upper portion of the insulator (9), an over-travel spring (11) and a piston (10) are sequentially disposed within the cylinder, one end of a piston rod penetrating the top opening of the insulator (9) is fixedly connected to the piston (10), and the other end of the piston rod is fixedly connected to the movable contact connecting rod (5) of the vacuum switching tube (1).

3. The intelligent integrated medium-voltage AC vacuum switchgear based on a flexible switching-closing technology according to claim 2, wherein the over-travel spring (11) is a compression spring or a disc spring.

4. The intelligent integrated medium-voltage AC vacuum switchgear based on a flexible switching-closing technology according to claim 1, wherein an infrared temperature measuring light guide (21) and an arc guide (19) are disposed on an outer side of the vacuum switching tube (1), and the infrared temperature measuring light guide (21) is electrically connected to an infrared temperature measuring transmitter (22) built in the controller (24), and is configured to detect a temperature of the vacuum switching tube (1) in switching and closing processes; the arc guide (19) is electrically connected to an arc light transmitter (20) built in the controller (24), and is configured to detect arc light intensity generated in the vacuum switching tube (1) in the switching and closing processes; and the infrared temperature measuring transmitter (22) and the arc light transmitter (20) are electrically connected to the intelligent circuit (23), and the intelligent circuit (23) performs calculation according to the detected temperature and arc light intensity to generate switching-closing parameters having a small arc and a small temperature rise.

5. The intelligent integrated medium-voltage AC vacuum switchgear based on a flexible switching-closing technology according to claim 4, wherein the vacuum switching tube (1) comprises a housing, a fixed contact (2), a fixed contact connecting rod (3), a movable contact (4), and the movable contact connecting rod (5), one end of the fixed contact connecting rod (3) is fixedly connected to the fixed contact (2) and is located within the housing, and the other end of the fixed contact connecting rod (3) is fixed to the housing and extends out of the housing; one end of the movable contact connecting rod (5) is fixedly connected to the movable contact (4) and is located within the housing, and the other end of the movable contact connecting rod (5) penetrates the housing and is connected to the housing in a slideable and sealed manner; the fixed contact connecting rod (3) and the movable contact connecting rod (5) are coaxial; and a light transmission part used for light measurement is disposed on the housing.

6. The intelligent integrated medium-voltage AC vacuum switchgear based on a flexible switching-closing technology according to claim 5, wherein the infrared temperature measuring light guide (21) and the arc guide (19) are both formed of optical fiber bundles.

7. The intelligent integrated medium-voltage AC vacuum switchgear based on a flexible switching-closing technology according to claim 1, wherein the switching-closing mechanism connecting piece (15) comprises a mechanism body, the transmission piece (12), the switching mechanism (13), and the closing mechanism (14), the switching mechanism (13) and the closing mechanism (14) are located within the mechanism body and are fixed to one end of the transmission piece (12), and the other end of the transmission piece (12) extends out of the mechanism body.

8. The intelligent integrated medium-voltage AC vacuum switchgear based on a flexible switching-closing technology according to claim 6, wherein the switching mechanism (13) comprises a magnetic cylinder disposed within the mechanism body and a switching coil fixed to the transmission piece (12), and the closing mechanism (14) comprises a magnetic cylinder disposed within the mechanism body and a closing coil fixed to the transmission piece (12).

9. The intelligent integrated medium-voltage AC vacuum switchgear based on a flexible switching-closing technology according to claim 1, wherein the emitting light guide (7) and the receiving light guide (8) are formed of optical fiber bundles having a photosensitive characteristic.

10. The intelligent integrated medium-voltage AC vacuum switchgear based on a flexible switching-closing technology according to claim 1, wherein a first light condensing device is disposed at the light outlet of the emitting light guide (7), a second light condensing device is disposed at the light inlet of the receiving light guide (8), and the first light condensing device and the second light condensing device are both formed of lenses or lens groups.

11. The intelligent integrated medium-voltage AC vacuum switchgear based on a flexible switching-closing technology according to claim 2, wherein a first light condensing device is disposed at the light outlet of the emitting light guide (7), a second light condensing device is disposed at the light inlet of the receiving light guide (8), and the first light condensing device and the second light condensing device are both formed of lenses or lens groups.

12. The intelligent integrated medium-voltage AC vacuum switchgear based on a flexible switching-closing technology according to claim 3, wherein a first light condensing device is disposed at the light outlet of the emitting light guide (7), a second light condensing device is disposed at the light inlet of the receiving light guide (8), and the first light condensing device and the second light condensing device are both formed of lenses or lens groups.

13. The intelligent integrated medium-voltage AC vacuum switchgear based on a flexible switching-closing technology according to claim 4, wherein a first light condensing device is disposed at the light outlet of the emitting light guide (7), a second light condensing device is disposed at the light inlet of the receiving light guide (8), and the first light condensing device and the second light condensing device are both formed of lenses or lens groups.

14. The intelligent integrated medium-voltage AC vacuum switchgear based on a flexible switching-closing technology according to claim 5, wherein a first light condensing device is disposed at the light outlet of the emitting light guide (7), a second light condensing device is disposed at the light inlet of the receiving light guide (8), and the first light condensing device and the second light condensing device are both formed of lenses or lens groups.

15. The intelligent integrated medium-voltage AC vacuum switchgear based on a flexible switching-closing technology according to claim 6, wherein a first light condensing device is disposed at the light outlet of the emitting light guide (7), a second light condensing device is disposed at the light inlet of the receiving light guide (8), and the first light condensing device and the second light condensing device are both formed of lenses or lens groups.

16. The intelligent integrated medium-voltage AC vacuum switchgear based on a flexible switching-closing technology according to claim 7, wherein a first light condensing device is disposed at the light outlet of the emitting light guide (7), a second light condensing device is disposed at the light inlet of the receiving light guide (8), and the first light condensing device and the second light condensing device are both formed of lenses or lens groups.

17. The intelligent integrated medium-voltage AC vacuum switchgear based on a flexible switching-closing technology according to claim 8, wherein a first light condensing device is disposed at the light outlet of the emitting light guide (7), a second light condensing device is disposed at the light inlet of the receiving light guide (8), and the first light condensing device and the second light condensing device are both formed of lenses or lens groups.

18. The intelligent integrated medium-voltage AC vacuum switchgear based on a flexible switching-closing technology according to claim 9, wherein a first light condensing device is disposed at the light outlet of the emitting light guide (7), a second light condensing device is disposed at the light inlet of the receiving light guide (8), and the first light condensing device and the second light condensing device are both formed of lenses or lens groups.

* * * * *